United States Patent [19]

Carter

[11] 4,066,720

[45] Jan. 3, 1978

[54] CARBURETOR AIR INTAKE VELOCITY STACK

[76] Inventor: Efton T. Carter, 2605 Irwin St., Lake Isabella, Calif. 93240

[21] Appl. No.: 392,883

[22] Filed: Aug. 30, 1973

[51] Int. Cl.[2] ..... F02M 9/06

[52] U.S. Cl. ..... 261/44 R; 123/52 M

[58] Field of Search ..... 123/52 M, 119 CG, 139 AW; 261/44 R; 415/182

[56] References Cited

U.S. PATENT DOCUMENTS

| | | | |
|---|---|---|---|
| 3,610,213 | 10/1971 | Gianini | 123/139 AW |
| 3,709,469 | 1/1973 | Edmonston et al. | 261/44 R |

FOREIGN PATENT DOCUMENTS

| | | | |
|---|---|---|---|
| 1,009,429 | 5/1957 | Germany | 123/52 M |
| 815,374 | 5/1951 | Germany | 415/208 |

*Primary Examiner*—Tim R. Miles

*Attorney, Agent, or Firm*—Michael A. Painter

[57] ABSTRACT

An improved carburetor air intake velocity stack for maximizing the quantity of air delivered to a carburetor. An air intake velocity stack is adapted to be coupled to the air inlet of a carburetor, the surface of the air intake stack substantially eliminating turbulance at the air intake velocity stack as well as increasing the density of air being input to the carburetor. The curvature of the intake stack provides for substantially laminar flow of the input air, the laminar flow being undisturbed by the shape of the input path.

2 Claims, 4 Drawing Figures

CARBURETOR AIR INTAKE VELOCITY STACK

BACKGROUND OF THE INVENTION

1. Field of the Invention

The present invention generally relates to air-fuel carbureting devices and, more particularly, to those portions of carbureting devices used for the imput of ambient air.

2. Prior Art

The improvement of carbureting devices has led to a number of highly sophisticated and expensive pieces of equipment which basically have the objective to increase the efficiency of the air-fuel mixture being delivered to a vehicle engine. The classical method of increasing power was to increase the manifold throat size of the carburetor to increase the air flow and thereby increase the available power. It was thought that an increase in throat and carburetor valve sizes would produce a comparable increase in power at the engine output. One of the approaches to increase power without increasing displacement was to obtain a higher charge to air-fuel mix in the engine chamber. Many of the devices disclosed by the prior art sought to increase the charge of the air-fuel mix by increasing the throat size, but this had an inherent problem. Merely increasing the throat size resulted in a corresponding drop in air flow speed which produced incomplete fuel atomization because the air flow through the carburetor was too slow.

One of the methods of moving the desired volume of air-fuel mix into the chamber of the engine is to adapt the throat diameter and shape of the air intake velocity stack to provide for proper air flow into the carburetor. The present invention air intake stack provides a proper balance between the shape of the air intake stack and the size of the throat to achieve the desired volume of air-fuel mix at an adequate air flow speed.

SUMMARY OF THE INVENTION

The present invention comprises an air intake velocity stack used with vehicle carburetors. The present invention is a key element in providing that the desired volume of air be input to the carburetor within a desired speed range. As an example, for motorcycle engines, an air flow speed of 240 – 300 feet per second is considered proper.

The criteria for providing adequate carburetion is to insure that the proper volume of air be input to the carburetor within the limits of the desired air flow speed. Air is a fluid, and like all fluids, has inertial properties. Air will present a resistive force to being started into motion as well as resisting any stopping force once it has gained momentum. Air, because of its molecular structure and laminar flow characteristics, will resist any change in direction and, if subjected to a direction change, will tend to expand or otherwise cause a reduction in the density of the air flow.

Although the present invention air intake velocity stack can typically be used with standard carburetors having a conventional air input port, for the purpose of example the present invention is considered to be used with carburetors such as those disclosed in U.S. Pat. No. 3,709,469 of which Applicant is a co-inventor or in Applicant's U.S. Pat. No. 3,822,058.

The present invention seeks to provide a compromise for an air intake velocity stack which optimizes the parameters of air flow velocity as well as the quantity of air delivered to the carburetor to provide a proper air-fuel mixture. As stated, the mere enlargement of the throat size of the air intake velocity stack can tend to reduce the air flow velocity and thereby result in a situation where the restart of air flow is resisted during the intake stroke of the engine. The compromise achieved by the present invention insures that the air flow is more responsive to the requirements of the engine by providing an adequate air-fuel mixture in the carburetor.

The present invention comprises a cylindrical throat which is adapted to be coupled to the air inlet port of the carburetor. Where a standard carburetor is used, the air moving through the velocity stack throat will be started and stopped by the opening and closing of the carburetor valves. In order to adapt the present invention velocity stack for optimum air flow, the throat is depended outwardly into a bell-like terminus which substantially insures that the flow of air into the carburetor will be maximized. Since the molecular structure of air will generally follow the laminar characteristics of a fluid, the terminus of the velocity stack follows a predetermined curve which minimizes random direction eddy flow of the air as it enters the throat of the air intake stack.

The curvature of the terminus of the air intake stack follows a defined relationship. From a point on the cylindrical throat of the air intake stack, the terminus thereof depends outwardly along a curve which is defined by a radius which decreases at a constant, linear rate. As a corrolary, all air being input to the present invention air intake stack flows along a surface which is defined by a radius which is increasing at a constant, linear rate. In this manner, random direction eddy flow is substantially precluded resulting in more constant air flow into the carburetor as well as increasing the density of the air flow.

It is therefore an object of the present invention to provide an improved carburetor air intake velocity stack.

It is another object of the present invention to provide an air intake velocity stack which maximizes air flow to a carburetor.

It is still another object of the present invention to provide an air intake velocity stack which substantially precludes turbulant eddy flow at the input to a carburetor.

It is still yet another object of the present invention to provide an improved carburetor air intake velocity stack which is inexpensive and simple to fabricate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

DESCRIPTION OF THE PRESENTLY PREFERRED EMBODIMENT

Figure 1:
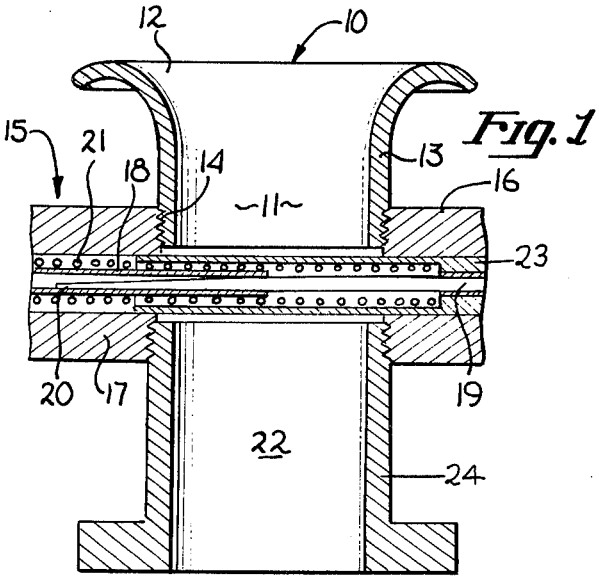
FIG. 1 is a cross-sectional view of the present invention carburetor air intake velocity stack mounted upon an exemplary carburetor and engine mount.
Figure 2:
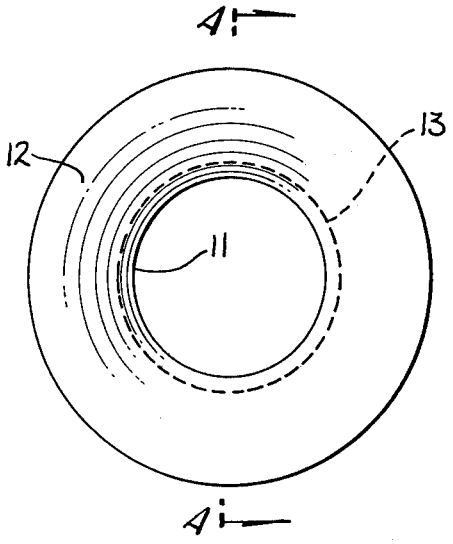
FIG. 2 is a top view of a form of the present invention carburetor air intake velocity stack illustrating the bell and throat of same.

Referring now to FIGS. 1 and 2, an understanding of the manner in which the present invention carburetor air intake velocity stack is used in conjunction with a vehicle carburetor can be best gained. The present invention velocity stack is generally designated by the referrence numeral 10. The air intake velocity stack 10 shown in FIG. 1 and FIG. 2 is mounted upon a carburetor which is similar to that described in U.S. Pat. No. 3,709,469 and Applicant's U.S. Pat. No. 3,822,058. Although the scope of the present invention is broad enough to allow use of the air intake stack 10 with carburetors employing conventional butterfly valves for controlling the flow, the present invention is shown being utilized with a carburetor as shown.

Referring to FIG. 1 and FIG. 2, the present invention air intake velocity stack 10 comprises a lower throat section 11 and an upper bell-like terminus 12 which will be explained in detail hereinbelow. Throat 11 is a substantially cylindrical section which integrally depends into terminus 12. The outer surface 13 of throat section 11 includes screwthreads 14 which adapt the present invention velocity stack to be coupled to the carburetor 15. Carburetor 15 as shown in FIG. 1 employs upper and lower mounting plates 16 and 17 respectively, screwthreads 14 of air intake velocity stack 10 being cooperatively received within upper plate 16. Carburetor 15 employs a fuel metering mechanism which includes liquid fuel tube 18 and fuel-metering needle 19 which has a flat, gradually tapering end 20 for controlling the fuel being input for combusion. The air metering system used by carburetor 15 includes a plate 23 disposed intermediate upper and lower plates 16 and 17 and includes a throttle opening which is resiliently adapted to open or close the portion of the present invention air intake stack 10 represented by throat 11. Axial spring 21 provides the resilient force necessary to control the fuel metering system of carburetor 15. The actual operation of carburetor 15 is beyond the scope of this application, the operation thereof being substantially similar to that described in U.S. Pat. No. 3,709,469 and Applicant's pending application Ser. No. 289,158 filed Sept. 14, 1972.

Carburetor 15 is coupled to the vehicle engine through the use of engine mounting fixture 24. The internal throat 22 of mounting fixture 24 is substantially aligned with throat 11 of the present invention air intake velocity stack 10 to provide for a consistent flow path when the air throttling mechanism is opened.

The present invention seeks to solve a problem arising out of the characteristcs of air as they may relate to the creation of a proper air-fuel mixture in a vehicle engine. As stated, air is treated as a fluid, and as a fluid, exhibits all of the characteristics of same. The inertial properties of air will cause it to resist going into motion once it is stopped as well as resisting any stopping force once it is in motion. As can be seen from the basic description of carburetor 15, the air throttling valve used therein as well as conventional butterfly valves may tend to start and stop the input of air to the carburetor and in fact to the vehicle engine itself. It has been determined that air-flow velocity is a critical value in providing an appropriate air-fuel mixture in the combustion chamber. It has been previously thought by increasing the throat size of the air intake member, there would be a corresponding improvement in the power produced by the engine. It has been found that merely increasing throat size causes a drop in air flow velocity and thereby produces incomplete fuel atomization because the air flow through the carburetor is too slow. The present invention carburetor air intake velocity stack 10 seeks to optimize the quantity of air delivered to a carburetor as well as providing the air input at appropriate air flow speeds.

Figure 3:
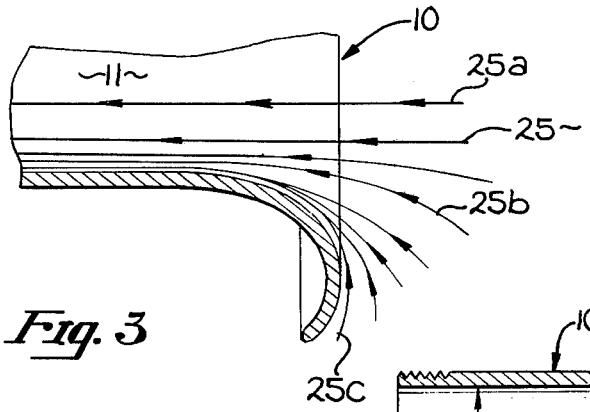
FIG. 3 is a partial, cross-sectional view of a portion of the present invention carburetor air intake velocity stack schematically depicting the laminar flow of air into the stack in accordance with the present invention.

Referring now to FIG. 3, a schematic view of a theoretical, ideal air input flow is shown with respect to a portion of the present invention air intake stack 10. As mentioned, unless the flow of air is interrupted thereby causing turbulant eddy flow, air will move in a laminar fashion in conformity with the characteristics of a fluid. As a result of the fluid characteristics of air, it will resist any change in direction and, if subjected to a direction change, will tend to expand its flow characteristics. As shown in FIG. 3, the body of air 25 is shown to be entering throat 11 of air intake velocity stack 10 in laminar strata 25*a*, 25*b* and 25*c*. As will be explained hereinbelow, the curvature of the bell-like terminus 12 provides a surface which will obviate any abrupt edges or directional changes and thereby permit air 25 to enter throat 11 without producing the turbulent eddy flow which would reduce the density of the air flow, the quantity of air delivered to the carburetor as well as the air-flow speed. As will be explained hereinbelow, the curvature of terminus 12 produces the substantially laminar flow represented by reference numerals 25*a*, 25*b* and 25*c* negating any turbulence which would cause the deleterious effects mentioned.

Figure 4:
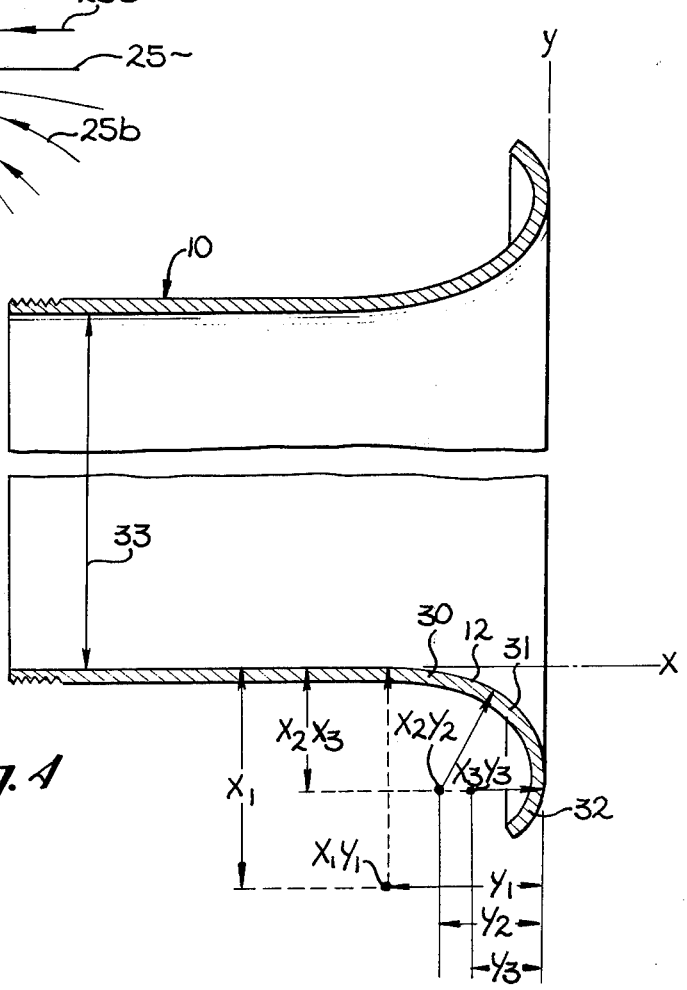
FIG. 4 is a cross-sectional view of the present invention carburetor air intake velocity stack taken through line 4—4 of FIG. 2 illustrating the graphical profile of the terminus section in accordance with the present invention.

In order to provide a surface which will input air in a substantially laminar fashion and preclude turbulance, the interior surface of terminus 12 follows a path which is defined by a curve which is defined by a radius which changes at a constant, linear rate. Referring now to FIG. 4, a partial, cross-sectional view of the present invention carburetor air intake velocity stack 10 is shown, the lower wall being aligned with graphical coordinates, the X axis being the abscissa, the Y coordinate being the ordinate. A mathematical analysis of the terminus surface 12 is based upon the representation shown in FIG. 4. For the purpose of simplicity, the quadrant shown shall be considered as the positive X and Y axes. Where ($r$) equals the radius of curvature of the surface of terminus 12, equations (1) and (2) set forth hereinbelow identify the differential equations which define the rate of change of the radius.

$$\frac{dr}{dx} = 2x + \frac{d(y^2)}{dx} \quad (1)$$

$$\frac{dr}{dy} = 2y + \frac{d(x^2)}{dy} \quad (2)$$

Since the curvature of surface 12 is defined by a radius which changes in a constant, linear manner, equation (3) identifies the constant rate of change of the radius.

$$\frac{dr}{dx} = \frac{dr}{dy} = K \tag{3}$$

Since the quantities of $dr/dx$ and $dr/dy$ are equivalent, equations (1) and (2) can be combined yielding equation (4) as follows:

$$2x + \frac{d(y^2)}{dx} = 2y + \frac{d(x^2)}{dy} \tag{4}$$

An approximation of the identity shown in equation (4) can be made by dividing the surface of terminus 12 into substantially equivalent segments as shown in FIG. 4. The segments shown are designated by the reference numerals 30, 31 and 32. It is an object of the present invention to provide a carburetor air intake velocity stack 10 which optimizes the characteristics of the quantity of air delivered as well as air flow speed. To accomplish this objective, the curvature of terminus 12 must be matched to the throat diameter which is designated by the reference numeral 33. The three contiguous segments designated by reference numerals 30, 31 and 32 have a radius which is defined by the coordinates $x_1y_1$, $x_2y_2$ and $x_3y_3$ respectively. As stated, this is an approximation of the mathematical formulation set forth in equations (1) - (4). The constants which are applied to determine the radius of segments 30, 31 and 32 is set forth hereinbelow. Although not shown in FIG. 4, a refined set of coordinates and constants for a radius $x_4y_4$ is shown in the following graph for the purpose of clarity.

Table 1

| Radius | Constants | |
|---|---|---|
| $x_1y_1$ | $x_1$=.571 | $y_1$=.422 |
| $x_2y_2$ | $x_2$=.313 | $y_2$=.277 |
| $x_3y_3$ | $x_3$=.313 | $y_3$=.159 |
| $x_4y_4$ | $x_4$=.365 | $y_4$=.079 |

Using the constants derived for the coordinate values, the radius of each segment 30, 31 and 32 of the curvature of terminus 12 can be determined irrespective of the throat size of the form of the present invention air intake velocity stack 10. As stated, the curvature of terminus 12 must be adapted to conform to the diameter 33 of throat 11 in order to provide an optimum design for air intake velocity stack 10. The $x$ and $y$ coordinate values for each radius of a segment is determined by multiplying the respective constants shown in Table 1 by the diameter 33 of the throat 11. As an example, Table 2 illustrates a set of actual coordinates for each radius of segments 30, 31 and 32 for forms of the present invention air intake stack 10 utilizing conventional throat diameters 33 and 32 millimeters or 40 millimeters.

Table 2

| | Coordinates (mm) | | | | | |
|---|---|---|---|---|---|---|
| | $x_1$ | $y_1$ | $x_2$ | $y_2$ | $x_3$ | $y_3$ |
| 32mm | 10.3 | 13.5 | 10.0 | 8.86 | 10.0 | 5.09 |
| 40mm | 22.8 | 16.8 | 12.5 | 11.1 | 12.5 | 6.36 |

The general constants set forth in Table 1 will provide the proper radial coordinates for the curvature of terminus 12 for any form of the present invention carburetor air intake velocity stack. The approximation representated by the constants set forth in Table 1 will substantially achieve the theoretical results represented by equations (1) - (4).

The present invention carburetor air intake velocity stack 10 provides apparatus for insuring that the air flow into a vehicle carburetor is optimized with regard to air flow velocity, density of the air as well as providing quantity which is not impeded by unwanted eddy flow. The present invention is generally fabricated out of conventional metallic material such as aluminum or steel. It has been found that where materials are used which are easily deformable, the metallic surface will flow into a properly structured die to yield the configurations shown. It is clearly within the scope of the present invention to cast or otherwise fabricate the elements of the present invention air intake stack by other conventional manufacturing techniques.

I claim:

1. A carburetor air intake velocity stack engageable with a carburetor inlet comprising:

a. a cylindrical throat section having first and second ends, said throat section having a uniform, interior diameter, the first end thereof being adapted to be coupled to the carburetor; and b. a terminus section integrally depending from the second end of said throat section and having an interior surface contiguous with the interior diameter of said throat section, said terminus section having first and second ends, the first end being contiguous with the second end of said throat section, the surface of said terminus section intermediate said first and second ends thereof being a surface of revolution about the axis of symmetry of said cylindrical throat section, said surface of revolution being defined by a curve having a constant first derivative of the radius of curvature, said terminus section intermediate said second and first ends thereof being defined by a radius of curvature commencing at said second end which radius of curvature increases at a constant, linear rate, whereby air drawn into said terminus is induced to flow in a substantially laminar manner.

2. A carburetor air intake velocity stack engageable with a carburetor inlet comprising:

a. a cylindrical throat section having first and second ends, said throat section having a uniform, interior diameter, the first end thereof being adapted to be coupled to the carburetor; and b. a terminus section integrally depending from the second end of said throat section and having an interior surface contiguous with the interior diameter of said throat section, said terminus section having first and second ends, the first end being contiguous with the second end of said throat section, the surface of said terminus section intermediate said first and second ends thereof being a surface of revolution about the axis of symmetry of said cylindrical throat section, said surface of revolution being defined by a curve having a constant first derivative of the radius of curvature, said terminus section intermediate the first and second ends thereof being defined by a radius of curvature commencing at said first end which decreases at a constant, linear rate, whereby air drawn into said terminus is induced to flow in a substantially laminar manner.

* * * * *